United States Patent [19]

Nelson

[11] Patent Number: 4,659,250

[45] Date of Patent: Apr. 21, 1987

[54] PAVEMENT EXTRACTOR

[76] Inventor: Daniel L. Nelson, Rte. 1, South, Box 175, Seminole, Tex. 79360

[21] Appl. No.: 758,026

[22] Filed: Jul. 23, 1985

[51] Int. Cl.[4] ..... E01C 23/12

[52] U.S. Cl. ..... 404/90; 172/26

[58] Field of Search ..... 404/90, 91, 92; 37/DIG. 19, DIG. 20, 80 R, 94; 172/26; 198/308, 522; 171/20, 120

[56] References Cited

U.S. PATENT DOCUMENTS

| | | | |
|---|---|---|---|
| 2,539,136 | 1/1951 | Hite | 404/90 |
| 2,562,400 | 7/1951 | Urschel | 198/308.1 |
| 2,756,520 | 7/1956 | Soule | 172/26 |
| 2,768,794 | 10/1956 | Putnam | 404/90 |
| 3,843,274 | 10/1974 | Gutman et al. | 404/91 |
| 4,313,502 | 2/1982 | Nelson | 171/63 |

FOREIGN PATENT DOCUMENTS

| | | | |
|---|---|---|---|
| 2713460 | 10/1977 | Fed. Rep. of Germany | 404/90 |

*Primary Examiner*—James A. Leppink
*Assistant Examiner*—Terry Lee Melius
*Attorney, Agent, or Firm*—Perry Carvellas

[57] ABSTRACT

An improved pavement extractor is disclosed herein which comprises a completely self-contained unit for removal of pavement in a situation where a new pavement is to be created. The device includes a combination of rippers and a hold-down pressure plate which efficiently extracts the pavement from the sub-base, a control chamber where the extracted pavement is led from the rippers and the hold-down pressure plate, which control chamber has located therein a pair of opposed rollers which controllably hold the pavement while a beater mechanism beats off pieces of the pavement of predetermined adjustable size. From the beater mechanism, the extracted pavement is conveyed to an elevator mechanism included in the device which conveys the now beaten small size pieces of pavement up to a sufficiently high level so as to enable the loading thereof into a vehicle such as a dump truck. The inventive pavement extractor is designed to be pulled by a crawler-type tractor which may have mounted thereon an automatic guiding device which also forms a part of the present invention. Through the use of the present invention, pavement as thick as 7 to 8 inches or more may be extracted.

18 Claims, 12 Drawing Figures

193
191
201
193
189
187
197
197
185
205
203
183
205
203
181
179
200
203
177
175
205
173
203
171
205
203
169
167
195
195
10
100
167

Fig. 10
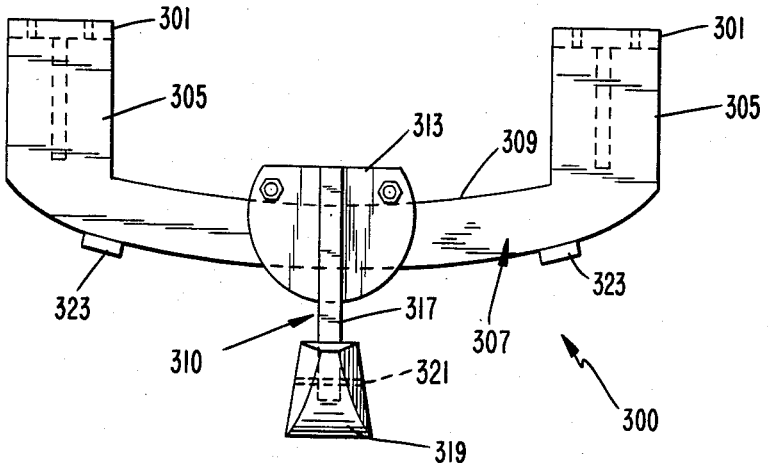
Fig. 11
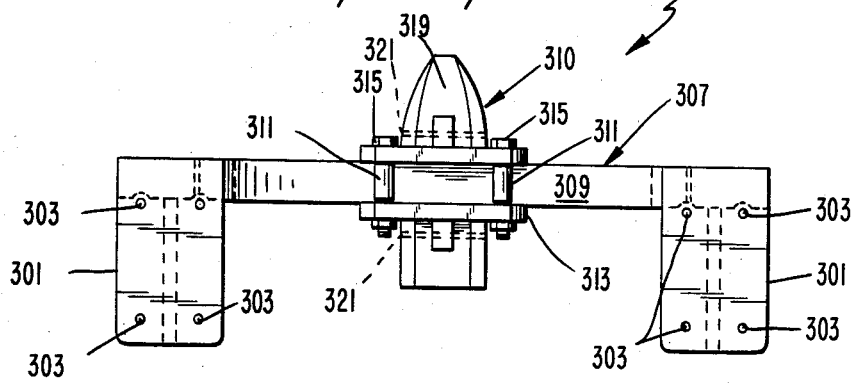
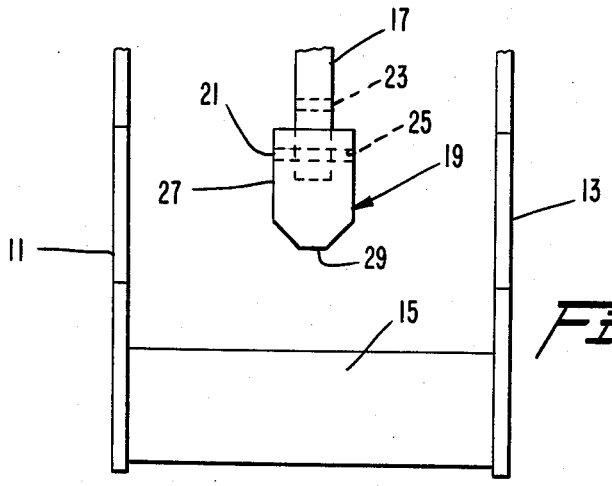
Fig. 12

PAVEMENT EXTRACTOR

BACKGROUND OF THE INVENTION

In the prior art, removal of pavement for the purpose of repaving a road, dsriveway, etc. has required the use of several the operation, a front-end loader is utilized to pick up the pavement material and load it onto trucks for hauling to a site for disposal.

Thus, it is seen that there is a dire need in the art of pavement removal for a device which combines many of the functions described hereinabove into one self contained unit. Such a device would save the costs of renting or buying pieces of equipment such as front-end loaders and the like and would more efficiently and quickly remove and process the pavement material for re-use on a roadway.

The following prior art is known to applicant:

U.S. Pat. No. 145,153 to Conrad discloses a hand cultivator wherein a plurality of triangular tooth-like hoe blades are provided and between each hoe blade, a vertical rake element is provided in spaced relation therefrom. This device is vastly different from the invention disclosed herein in that (1) the hoe blades are disposed at right angles to the orientation of the inventive rippers herein and (2) the rake elements thereof are quite narrow in dimension and would not provide the interaction which exists between the rippers and hold-down pressure plate of the present inventon.

U.S. Pat. No. 800,005 to McEwing discloses a blocking and cultivating machine having blocking shoes placed between the cultivator teeth. The blocking shoes sever the soil in each side of a row to be left and protect the row from soil thrown outwardly by the cultivator. The device disclosed by McEwing is vastly different from that of the present invention in that (1) the blocking shoes are designed to move with respect to the cultivators during the operation of the device whereas in the present invention the rippers and the hold down-pressure plate are designed to be rigidly spaced from one another during the operation thereof, and (2) there is no structure in McEwing even remotely resembling the control chamber, elevator and associated structure of the present invention.

U.S. Pat. No. 2,539,136 to Hite discloses a surface crusher towed behind a tractor. The main frame thereof carries a plurality of teeth having lower forwardly directed extensions and chisel shaped ends which cooperate with a crushing rotor having a plurality of elements disposed about an axle. These elements interdigitate with the above described teeth to break up locks. The main difference between this invention and the invention disclosed herein lies in the fact that the present invention includes fixed rippers in conjunction with a fixed hold-down pressure plate whereas the Hite invention utilizes a rotating rotor with a plurality of elements disposed thereabout which rotate during the operation of the device. This, of course, is vastly different from the teachings of the present invention.

U.S. Pat. No. 3,843,274 to Gutman, et al, discloses an asphalt reclaiming device wherein a rotary cutter with a plurality of teeth or blades is disposed transversely of the vehicle and behind a heater so as to cut up the heated asphalt and push it into a pugmill. The teeth are arranged in a spiral along the cutter shaft which also includes a continuous blade forming another spiral between the spiral of teeth (FIG. 4). Similarly to the above described U.S. patent to Hite, this patent includes the use of a rotary element for removal of the pavement whereas in the present invention, the hold-down pressure plate and the rippers are stationary with respect to one another.

U.S. Pat. No. 3,952,811 to Carre discloses a rock crusher similar to the above discussed U.S. patent to Hite wherein a plurality of teeth or plowshares cooperate with a plurality of hammers disposed along the shaft of a rotor. As disclosed with regard to Hite, these hammers interdigitate with the plowshares to crush rocks and other material razed by the device. The differences between the present invention and Carre are the same as the differences between the present invention and Hite.

U.S. Pat. No. 4,322,178 to Lee discloses a pavement patching apparatus including a backhoe provided with a cutting blade at the back of the bucket and screeding edges underneath (FIG. 1). The cutting blade is used to cut into pavement when the bucket is tilted so that the open end thereof is pointed upwardly. FIG. 1 shows the blade in contact with the pavement and the rear ends of the screeding edges resting on the surface. This device is vastly different from the device disclosed herein in view of the variations in angle of attack of the bucket with respect to the pavement and further in view of the fact that Lee does not show any of the details of the control chamber, elevator and associated structure disclosed herein.

SUMMARY OF THE INVENTION

The present invention overcomes the deficiences shown in the prior art as discussed hereinabove by providing a self-contained improved pavement extractor apparatus including the following combination of structural features:

(A) The improved pavement extractor of the present invention includes, firstly, a pair of rippers rigidly affixed to the device in parallel relation to one another, which rippers include aligned pointed ends which are provided so as to enable the rippers to dig themselves into the pavement due to forward movement of the extractor. Connected between the rippers is a floor device which provides a path for the pavement to take past the rippers as the pavement is ripped up thereby.

(B) Mounted in spaced relation to the above described floor between the rippers is a hold-down pressure plate comprised of a pressure plate member extending substantially parallel to the direction of extent of the rippers and having attached thereto a shoe mechanism. The shoe mechanism is adjustable with respect to the pressure plate member so that the improved pavement extractor may be adapted for removal of pavements of differing thicknesses.

(C) Pavement which has been ripped up by the combination of hold-down pressure plate and rippers is conveyed through the movement of the extractor as pulled by a vehicle such as a crawler-tractor into a control chamber including a fixed-floor and side walls with a floating top which aids in controlling the flow of the ripped-up pavement therein.

(D) Beyond the floating top, two opposed rollers are provided with the lower roller being fixed to a main frame portion of the invention and the upper roller being attached to an inner sub-housing thereof, with the spacing between these rollers being continuously adjustable against the force of adjustable spring biasing means. The movement of the ripped-up pavement through the rollers adjusts the spacing and the resilient spring biasing means is utilized to hold this moving ripped-up pavement in a controlled fashion.

(E) Beyond these rollers, a beater mechanism is provided which includes a rotary device having blades thereon which is designed to break off small pieces of the pavement as the above described rollers controllably hold the pavement. The size of the pieces which the beater mechanism breaks off may be controlled by adjusting the tension of the above described tension spring biasing means as well as by adjusting the extent to which the blades of the beater mechanism extend into the control chamber.

(F) Beyond the beater mechanism, an elevator is provided which conveys the beaten-up pavement up to a high enough level so as to be deposited into a vehicle such as a dump truck.

(G) The moving parts in the inventive extractor, in particular the beater mechanism and the conveyor are both simultaneously operated by a fluid motor means which is operably connected to these devices through the use of various chains, sprockets, gear boxes and the like as will be described in greater detail hereinafter.

A preferred embodiment of the improved pavement extractor of the present invention comprises:

(a) A main housing with a front and back end.

(b) A pair of rippers attached to the front end of the main housing, each ripper including a top edge and a bottom edge and a substantially point front end. The rippers are mounted on the front end of the main housing with the pointed front ends facing forward and with a predetermined spacing between the rippers.

(c) A hold down pressure plate means is mounted on the front end of the housing within the spacing between the rippers and at predetermined height above the pointed ends of the rippers. The hold down pressure plate means and the rippers define an opening between the rippers and below the hold down pressure plate means.

(d) Means attaching the extractor to a vehicle.

The forward movement of the vehicle causes the extractor to move forward and causes the pointed ends of the rippers to bite into the pavement. This causes the pavement to be extracted and lifted upward along the upper edge of the rippers. The hold down pressure plate means bears down on the top of the pavement between the rippers to thereby cause the extracted pavement to be forced downward. The continued forward movement of the extractor forces the extracted pavement through the opening between the rippers and below the hold down pressure plate means.

Accordingly, it is a first object of the present invention to provide an improved pavement extractor which enables the saving of the extracted pavement material for recycling rather than requiring abandonment thereof.

It is a further object of the present invention to provide an improved pavement extractor which is competely self-contained and eliminates the requirement of a front-end loader to pick up broken pavement for removal from the sub-base.

It is a further object of the present invention to eliminate the use of sheep foot tamper-type devices in breaking up existing pavement by providing a beater mechanism which performs this function therewithin.

It is a further object of the present invention to provide an improved pavement extractor which may be adjustable to extract pavements of various depths up to a depth of at least seven or eight inches or more.

It is still a further object of the present invention to provide a guide device for the vehicle that pulls the extractor, which guide device enables the aligning of the extractor with the swath of pavement which is to be extracted so as to save time and labor costs in the lining-up of the machine for use.

These and other objects, aspects and features of the present invention will become more apparent from the following detailed description of the preferred embodiment when read in conjunction with the appended drawing figures.

BRIEF DESCRIPTION OF THE DRAWINGS

FIGS. 10 and 11 show front and top views, respectively, of the guide mechanism utilized in conjunction with the present invention in a positoin attached to the front portion of the vehicle which is pulling the inventive pavement extractor.

FIG. 12 shows an end-view of the relationship between the rippers, hold-down pressure plate and the floor between the rippers.

SPECIFIC DESCRIPTION ON THE PREFERRED EMBODIMENTS

Figure 1:
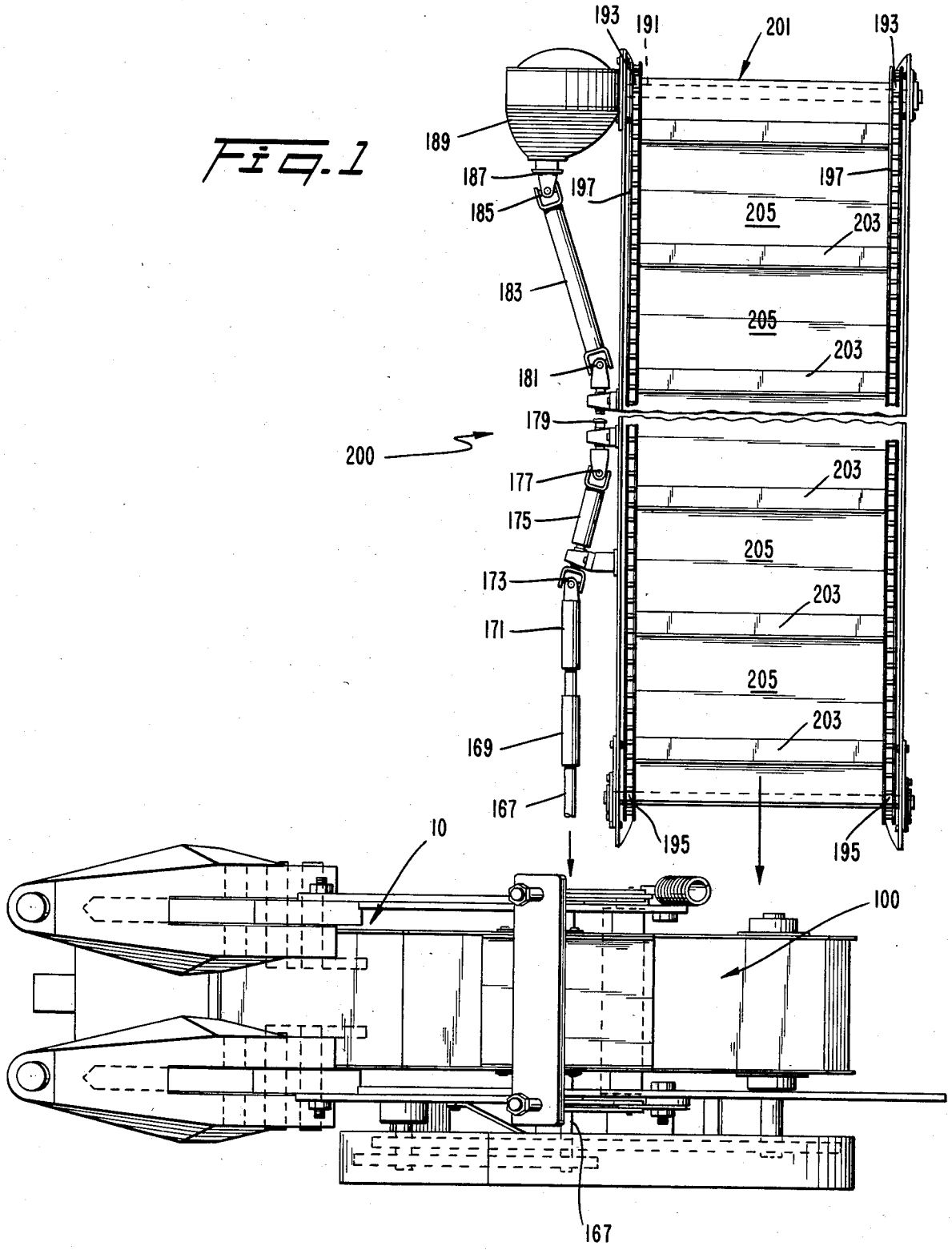
FIG. 1 shows a top-view of the invention with certain parts thereof broken away to show detail.
Figure 2:
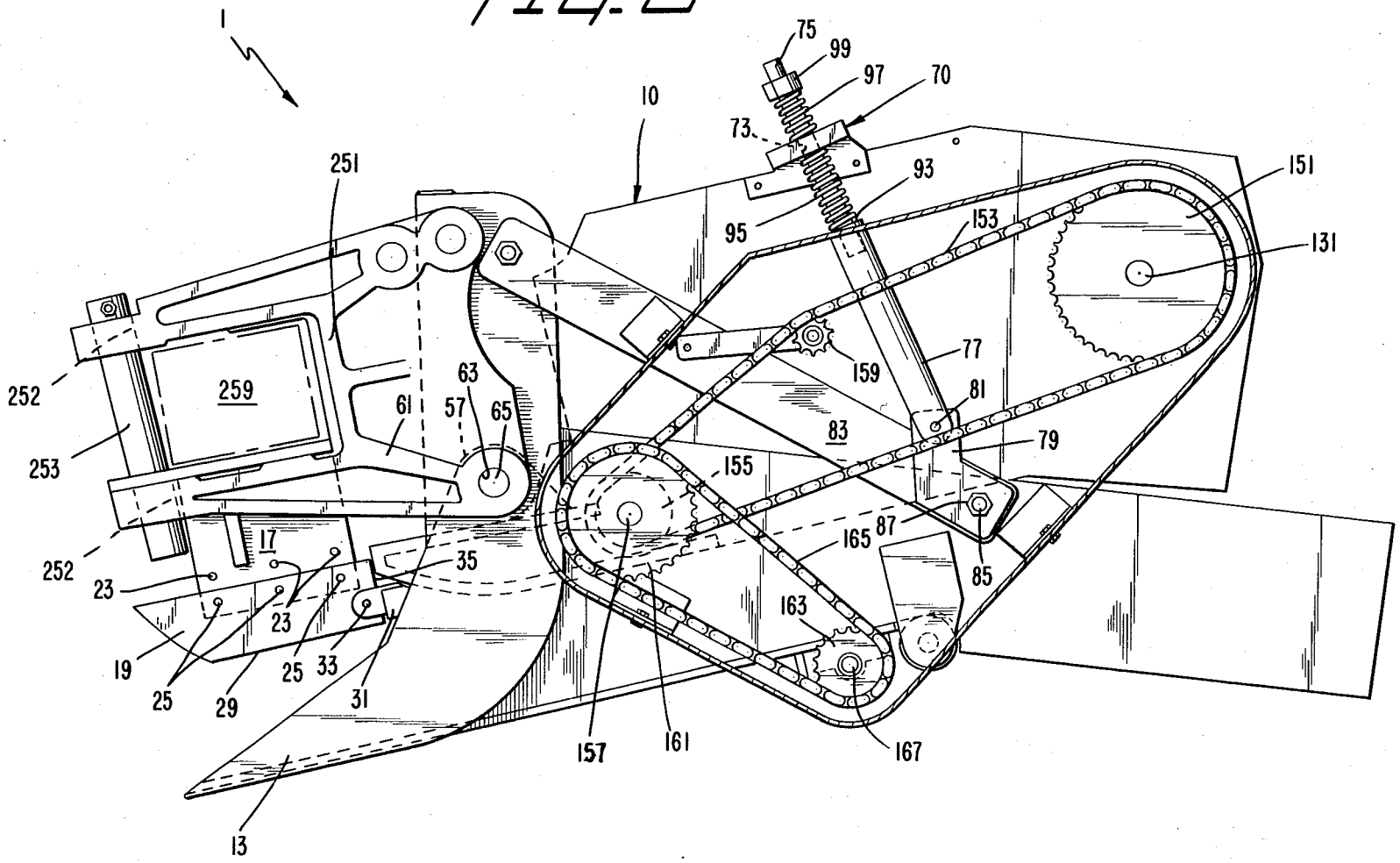
FIG. 2 shows a left-side view of the invention with certain parts broken away to show detail and with the conveyor mechanism removed therefrom.
Figure 3:
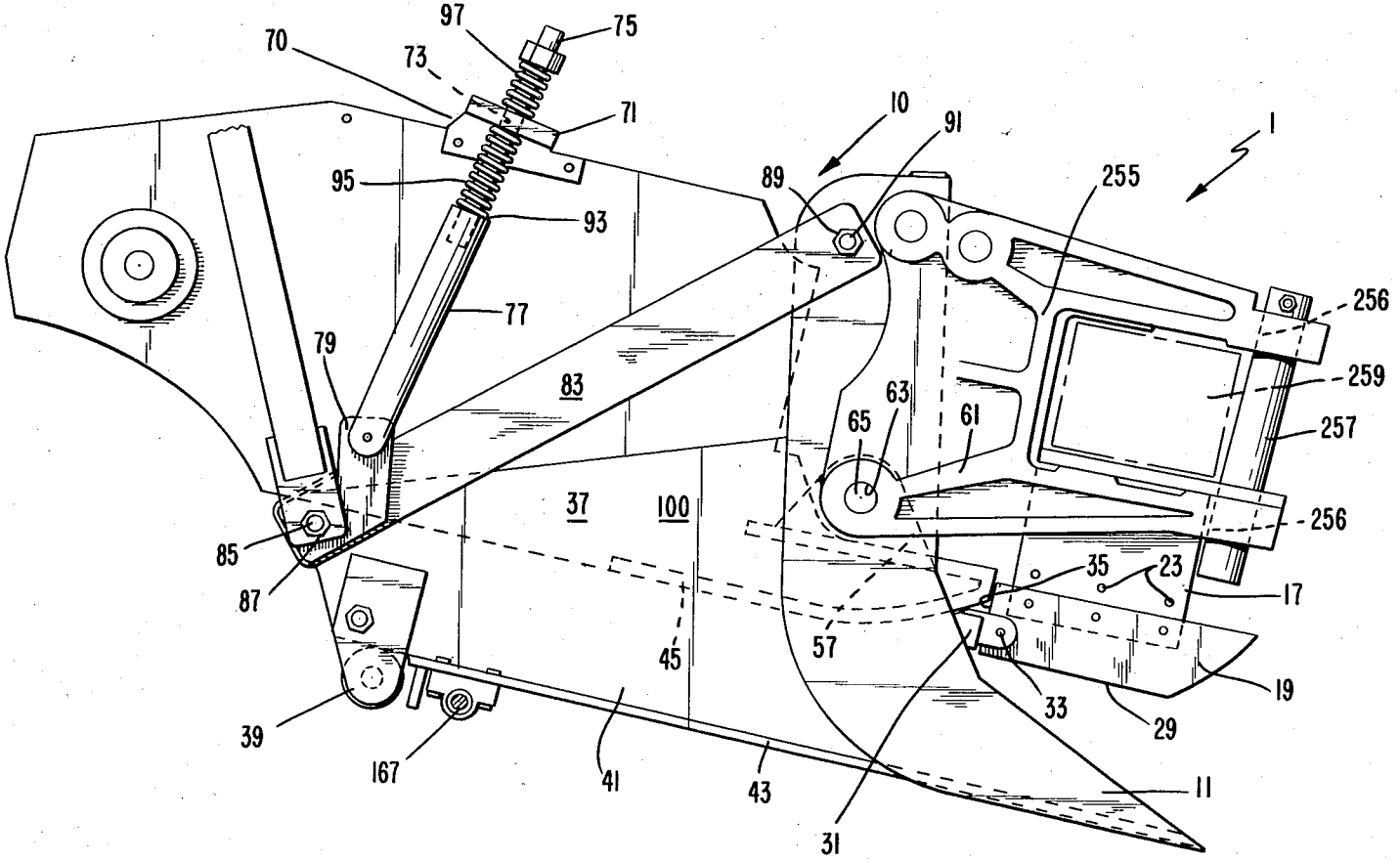
FIG. 3 shows a right-side view of the present invention again with certain parts broken away to show detail.

With reference now to FIG. 1, the inventive pavement extractor is seen from a top view. The inventive extractor is seen to have a main housing generally designated by the reference numeral 10, an inner housing 100 and an elevator mechanism 200. With reference now to FIGS. 2, 3 and 12, the main housing 10 is seen to have attached thereto a pair of rippers 11 and 13 which have connected therebetween a floor 15 as best seen in FIG. 12. Located in spaced relation with the rippers 11 and 13 is a pressure plate 17 having attached thereto a rigid shoe 19 which is attached to the pressure plate 17 by pins 21 which may, if desired, comprise rubber expansion pins. The spacing between the shoe 19 and the floor portion 15 may be adjustable by removing the pins 21 and by then sliding the shoe 19 up or down along the pressure plate 17 until adjusting holes 23 become aligned with the holes 25 in the neck portion 27 of the shoe to thereby enable the installing therein of the pins 21. The spacing between the face 29 of the shoe 19 and the floor portion 15 is adjusted to a particular spacing related to the thickness of pavement which is to be removed. For example, if the pavement to be removed is approximately 7 inches thick, the spacing between the face 29 of the shoe 19 and the floor portion 15 would be adjusted approximately to a spacing of 8 inches so as to provide sufficient space therebetween to enable the pavement to traverse therethrough including sufficient spacing to account for buckling of the pavement as it is ripped up by the inventive extractor. As further shown in FIGS. 2 and 3, a floating plate 31 is connected to the shoe 19 by a pin 33 and when the extractor is not operating, this floating plate 31 hangs downwardly from the position shown in FIGS. 2 and 3. When pavement is being extracted in accordance with the teachings of the present invention, the movement of the pavement through the device causes the floating plate 31 to pivot upwardly to the position shown in FIGS. 2 and 3. The floating plate 31 is provided to provide a continuation of the upper ceiling in the chamber for a continued unrestricted flow of material through the chamber.

With further reference to FIGS. 3, 4, 5 and 7 it is seen that the inner housing 100 has mounted thereon an upper roller 37 which is essentially opposed to a rear roller 39 (FIG. 3). The pavement after passing the floating plate enters a control chamber 41 which is defined between the main housing 10 and the inner housing 100. The main housing 10 defines the bottom on 43 of the control chamber as well as the side walls thereof while the inner housing 100 defines the upper ceiling 45 of the control chamber 41.

Figure 4:
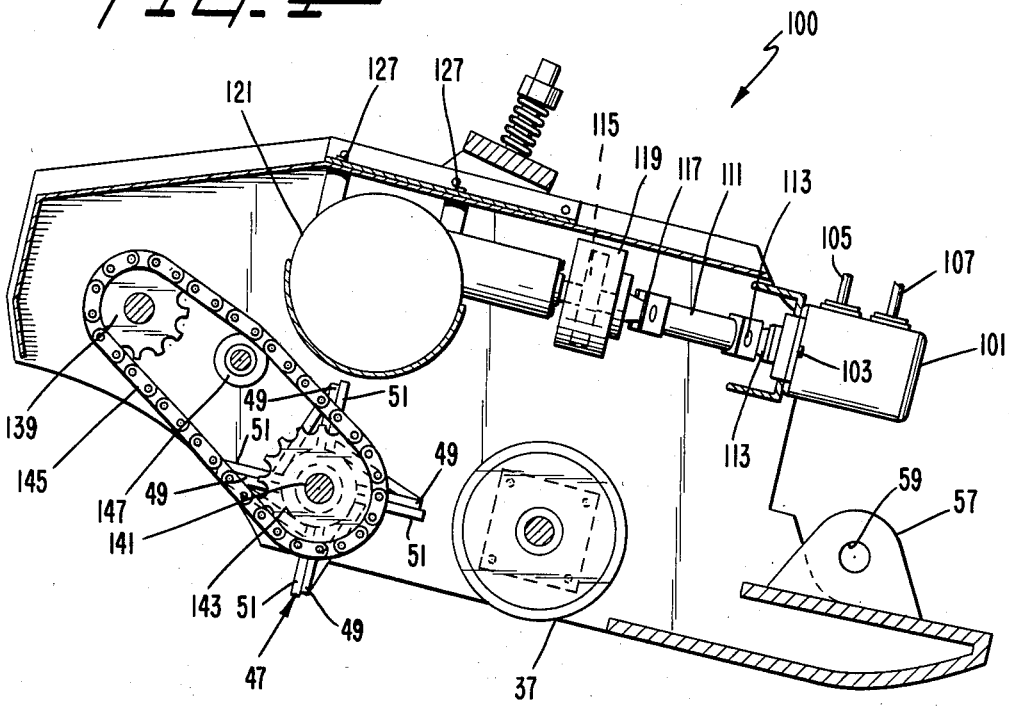
FIG. 4 shows a right-side view of the inner sub-housing of the present invention.
Figure 5:
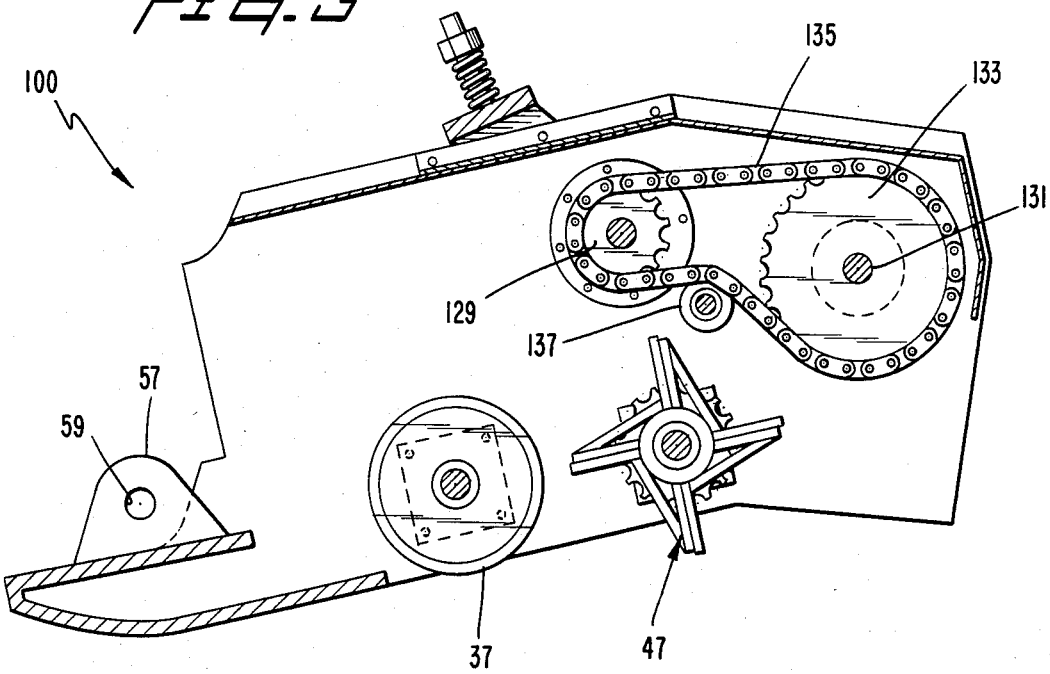
FIG. 5 shows a left-side view of the inner sub-housing of the present invention.
Figure 7:
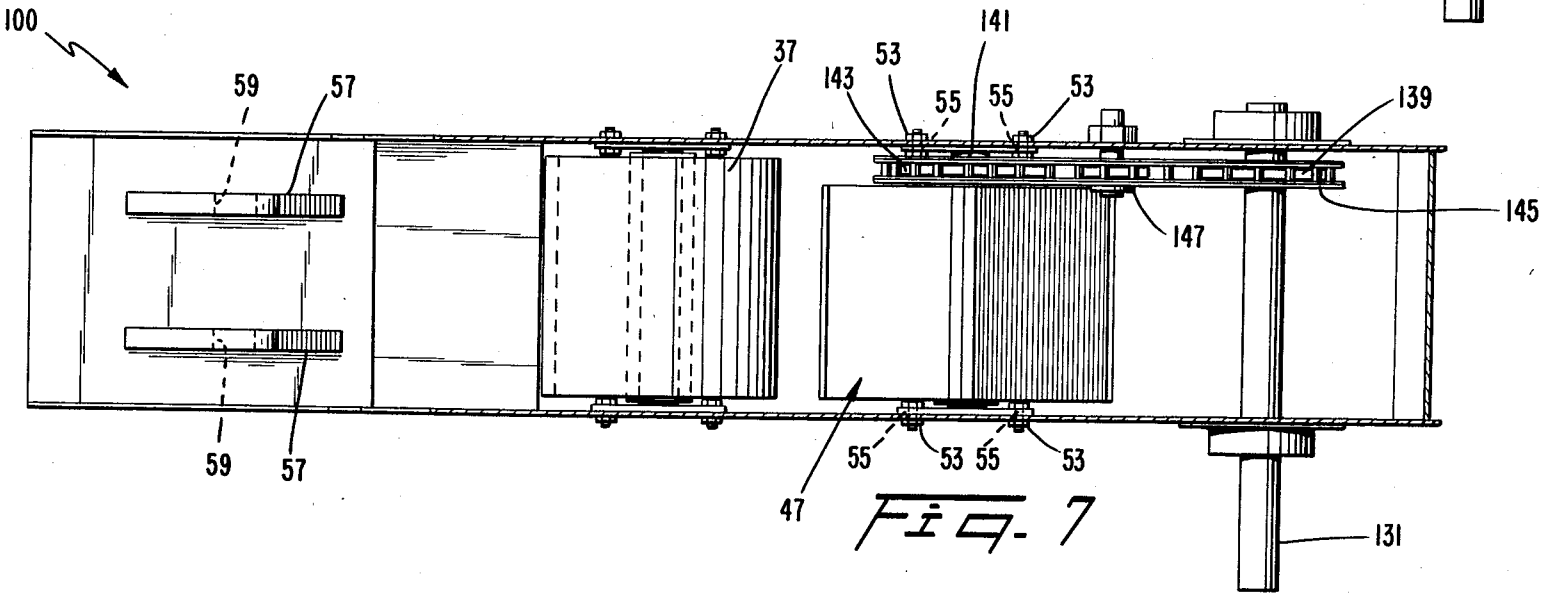
FIG. 7 shows a further top-view of the inner sub-housing of the present invention with certain parts thereof removed to reveal details of the beater mechanism and upper roller.

As best seen with reference to FIGS. 4, 5 and 7, beyond the upper roller 37 with respect to the floating plate 31, the inner housing 100 has mounted therein a beater 47 including, in this example, four bracket members 49 each of which removably supports a device 51 made of a material suitable for beating off pieces of the pavement. As best seen in FIG. 7, the beater 47 is mounted on the inner housing 100 by bolts 53 which extend through slots 55 in the inner housing. The slots 55 are provided in the inner housing 100 so that the position of the beater mechanism 47 with respect to the control chamber 41 may be adjusted by loosening the bolts 53 so as to adjust the amount of material beaten off by the beater mechanism 47 with each revolution thereof.

With reference to FIGS. 3 and 7, it is seen that the inner housing 100 is attached to the main housing 10 by virtue of support brackets 57 each of which has a hole 59 therethrough. The main housing 10 includes a pair of corresponding brackets 61 each of which has a hole 63 therethrough which is adapted to align with the respective hole 59 in the respective bracket 57. As shown in FIG. 3, after this alignment has taken place, a pin 65 is placed through the aligned holes 59 and 63 to thereby pivotally connect the inner housing 100 to the main housing 10.

With reference now to FIGS. 2 and 3, it is seen that the pivotal attachment of the inner housing 100 to the main housing 10 is for the specific purpose of controlling the size of the control chamber 41 to thereby enable control of the pavement as it traverses the control chamber 41. For this purpose, each side of the inner housing 100 is attached to a corresponding side of the main housing 10 via a spring assembly 70.

With references to FIGS. 2 and 3, the inner housing 100 has rigidly mounted thereto a plate 71 having holes 73 therethrough through which extend the rods 75. Each respective rod 75 is attached to a further rod-like arm member 77 which is attached to an angular plate 79 through the use of a pin 81 which allows the arm 77 to pivot with respect to the plate 79. The plate 79 is attached to a flat plate 83 with a bolt 85 and nut 87 which the flat plate 83 rigidly to the main housing. Each flat plate 83 is connected to the main housing rigidly to the main housing 10 by further bolt 89 and nut 91.

Each rod 75 and respective arm 77 define therebetween a shoulder 93. Between each shoulder 93 and the bracket 71, a shock absorbing spring 95 is mounted on the rod 75. Further, between the bracket 71 and a nut 99 threaded about the end of the rod 75, a further pressure-controlled spring 97 is placed on the rod 75. The spring 95 is provided to absorb shocks which are caused by the movement of the pavement through the control 41 while the spring 97 is provided to hold the surface 45 of the inner housing 100 which forms the top or ceiling of the control chamber 41 in spring biased relation against the pavement as the pavement tends to push the surface 45 and thereby the housing 100 in a direction opposed to he spring force created by the spring 97. Through adjustment of the adjusting nut 99, the amount of pressure exerted by the face 45 of the housing 100 against the pavement material may be adjusted while simultaneously adjusting the firmness of the shock absorbing effect of the spring 95.

Figure 6:
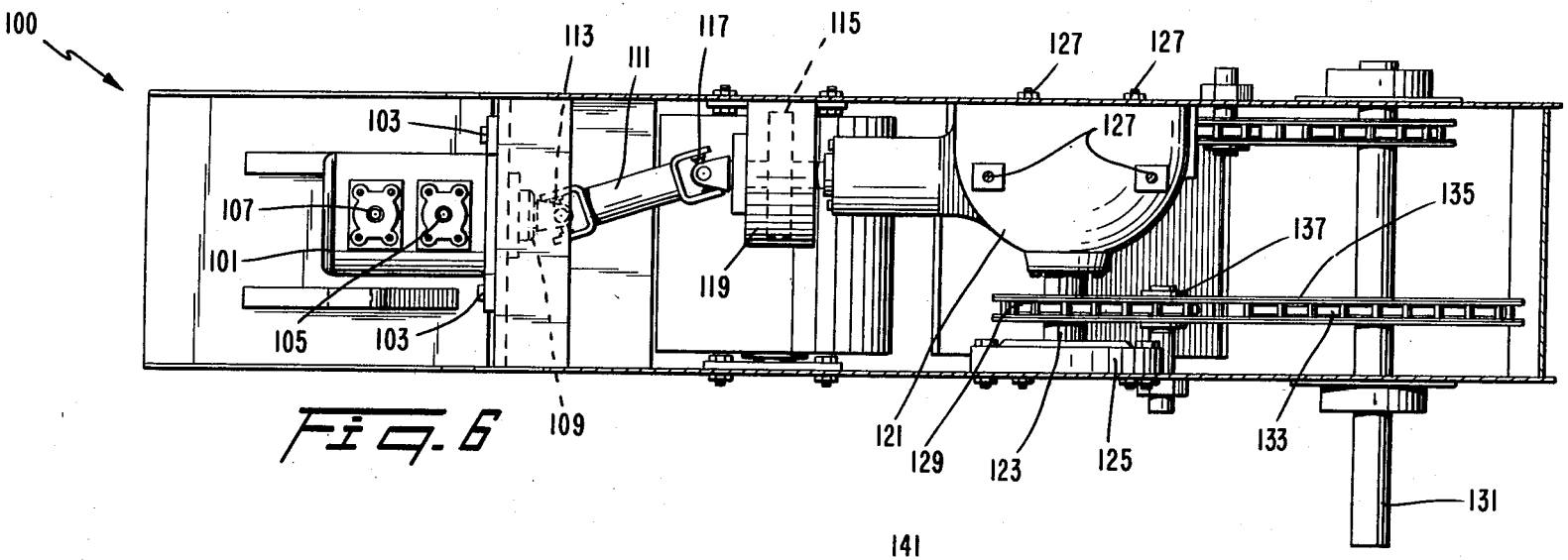
FIG. 6 shows a top-view of the inner sub-housing of the present invention.

Now, with reference to FIGS. 1, 2, 4, 5, 6 and 7, the drive mechanism for the beater mechanism 47 and the elevator 200 will now be described. FIGS. 4 and 6 illustrate a hydraulic motor 101 rigidly connected to the inner housing 100 through bolts 103. The hydraulic motor 101 includes an input line 105 and an output line 107 which convey hydraulic fluid to and from a pump (not shown) so as to drive the motor impeller (not shown) which acts to rotate output shaft 109 with a speed dependent upon the pump speed. The output shaft 109 is connected to an input power shaft 111 via a universal-type coupling 113 with the other end of the input power shaft 111 being connected to a further shaft 115 via a further universal-type coupling 117. Splined onto shaft 115 is a fly wheel 119. The shaft 115 constitutes the input shaft for a right-angle drive gear box 121. The gear box 121 includes an output power shaft 123 (FIG. 6) which is driven by the shaft 115 via gears (not shown) within the right-angle drive gear box 121. These gears may provide any desired gear ratio between the shaft 115 and the shaft 123 as is desired depending upon the particular application. As can be seen in FIG. 5, the end of the shaft 123 extends into a bearing housing 125 which is provided to carry the shaft 123 in bearing relation. As further shown in FIGS. 4 and 6, the right-angle drive gear box 121 is rigidly mounted onto the inner housing 100 by bolts 127.

With reference now to FIGS. 4 and 6, it is seen that the power shaft 123 has rigidly mounted thereon a sprocket 129 which enables power transfer between the power shaft 123 and jack shaft 131 via a further sprocket 133 rigidly mounted to the jack shaft 131 and a chain 135 which operatively connects the sprockets 129 and 133. An adjustable chain tension idler 37 is also provided so that the tension of the chain 137 may be accurately adjusted. Thus, operation of the hydraulic motor via the input power shaft 111, the gear box 121 and the sprockets 129 and 133 causes the jack shaft 131 to rotate at a speed dependent upon the speed of rotation of the hydraulic motor as well as by the gear ratios created by the right-angle drive gear box 121 as well as by the ratio created by the number of teeth in the respective sprockets 129 and 133.

With reference to FIGS. 4 and 5, it is seen that the jack shaft 131 has rigidly mounted thereon a further sprocket 139. The beater mechanism 47 is rotatably mounted on a shaft 141 which also has rigidly mounted thereon a further sprocket 143. A chain 145 is placed over the respective sprockets 139 and 143 and the tension thereof is adjusted by adjustable chain tension idler wheel 147. Accordingly, rotation of the jack shaft 131 will cause the sprocket 139 to rotate to thereby cause beater mechanism 47 to rotate at a speed dependent upon the above described gear ratios as well as the ratio between the number of teeth on the respective sprockets 139 and 143. 1

With further reference to FIG. 2, it is seen the jack shaft 131 has a further sprocket 151 rigidly mounted thereon which connects via chain 153 with a further sprocket 155 mounted on a relay shaft 157. A chain tension idler 159 is provided to adjust the tension on the chain 153. The relay shaft 157 has further mounted rigidly thereon a sprocket 161 which is drivingly connected with a further sprocket 163 via further chain 165. The sprocket 163 is rigidly mounted on the elevator drive shaft 167 which is also seen in FIG. 3 and more particularly is shown in FIG. 1 extending under the device to a point thereon the other side of the main housing 10 removed from the sprocket 163.

Figure 8:
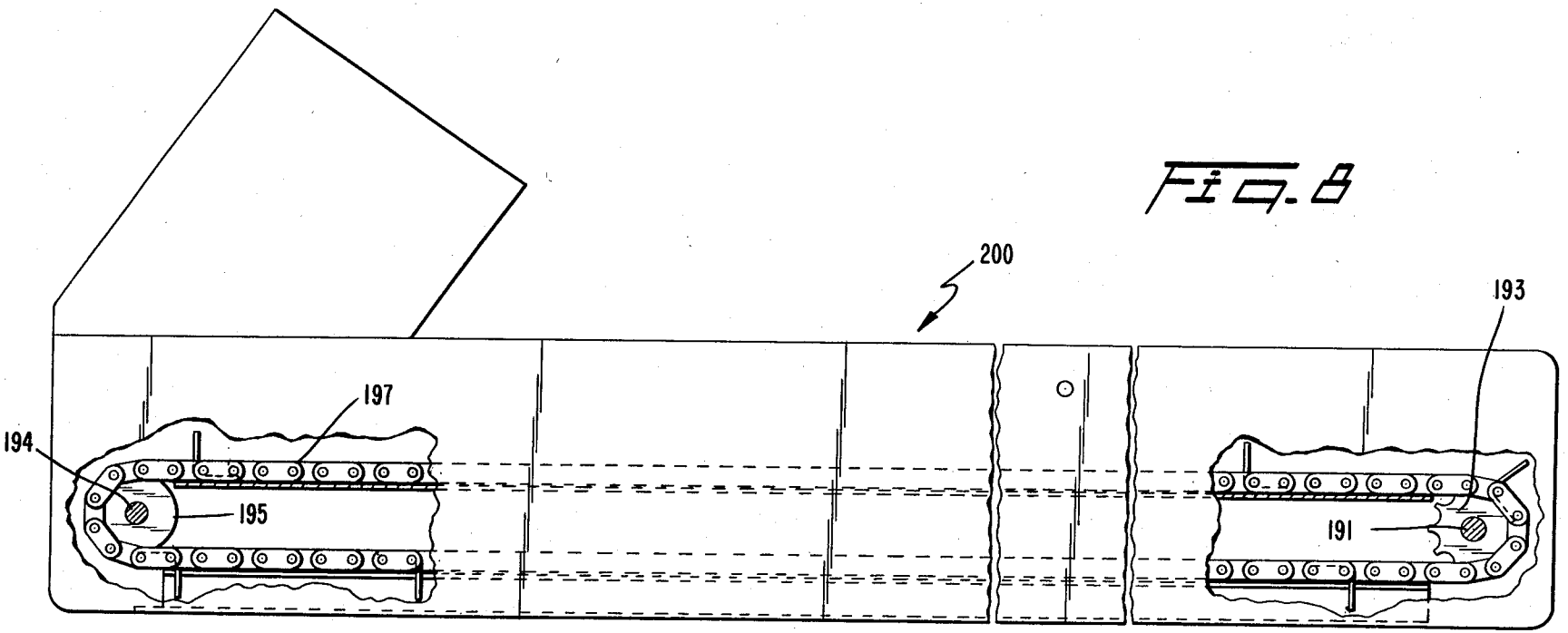
FIG. 8 shows a side-view of the conveyor mechanism shown in FIG. 1.
Figure 9:
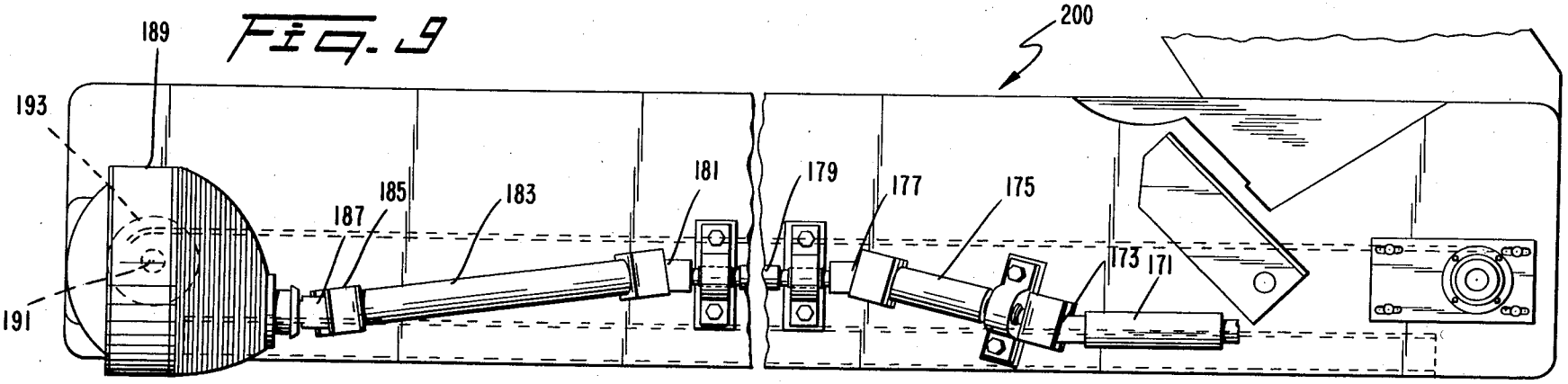
FIG. 9 shows the other side of the conveyor mechanism in FIG. 1 showing details of the driving mechanism therefor.

With reference now to FIGS. 1, 8 and 9, the structural and driving relation between the elevator mechanism 200 and the main and inner housings 10, 100 will now be described. As shown in FIGS. 1 and 9 in particular, the elevator drive shaft 167 is connected via a coupling member 169 with the input shaft 171 for the conveyor drive system. The shaft 171 is connected via a universal joint 173 with a further shaft 175 which is connected via a further universal coupling 177 with a further shaft 179 connected via a further universal connection 181 with an angularly disposed shaft 183 which connects via a further universal connection 185 to the input shaft 187 for the right angle drive gear box 189. This gear box 189 has an output shaft which transmits power from the input shaft 187 via gears (not shown) the ratio of which may be set at any desired ratio. The output shaft 191 of the right angle drive gear box 189 drives a pair of sprockets 193 one of which is best seen in FIG. 8. A chain 197 is drivingly engaged with each respective sprocket 193 and the other end of each respective chain 197 is made to extend around a respective bearing member 195 located at the lowest portion of the elevator mechanism 200.

As best seen in FIG. 1, the elevator includes chains 97 installed in a manner well known to those skilled in the art. At spaced intervals along the chains 197, upstanding drag slats 203 are provided which create between respective adjacent drag slats 203 containment areas 205 which carry the pulverized pavement materials as pulverized by the inventive extractor up to a point at the uppermost portion of the elevator 200 where they may be loaded onto an adjacent vehicle such as for example a dump truck.

The elevator 200 may be connected to the main housing through a variety of means not considered to be essential to the teachings of the present invention. One example of an appropriate means of attachment may comprise pivotally attaching the elevator to the main housing with a further connection between the conveyor and housing being for the purposes of support as well as adjustment. Such adjustment might be possible through the use of a hydraulic cylinder interposed in a support between the elevator and the housing which hydraulic cylinder could be useable to adjust the angle of the elevator 200 with respect to the main housing 10. Other suitable means of connection and support for the elevator 200 with respect to the main housing 10 may be contemplated by those skilled in the art.

Referring now to FIGS. 10 and 11, the invention includes a guide mechanism which is intended to be attached to the front of the vehicle which is utilized to pull the pavement extractor. For the purposes of this explanation, it will be assumed that the vehicle utilized to pull the improved pavement extractor comprises a crawler-tractor (not shown) including a hydraulically operated front blade which may be raised and lowered in a controlled fashion. As shown in FIGS. 10 and 11, the guide mechanism 300 includes a pair of brackets 301 which have holes 303 therethrough which enable the bolting of the guide mechanism 300 to the underside of the dozer blade (not shown) of the crawler-tractor. As shown in FIG. 10, depending from the brackets 303 are straight portions 305 which are connected to one another through a bar member 307. The bar member 307 includes a curved upper surface 309 for a purpose to be described hereinafter. The guide member 310 includes a pair of plates 313 between which are sandwiched a pair of rollers 311 which are attached therebetween through the use of bolts 315 as best seen in FIG. 11. A depending plate 317 is attached to the plates 313 and extends downwardly below the member 307. Attached to the plate 317 by virtue of pins 321 is an elongated guide 319 which is adapted to be lowered through the lowering of the dozer blade into a space created by the removal of a swath of pavement by the inventive extractor. The guiding device 310 with the guide 319 attached thereto may be laterally adjusted on the member 307 by moving the device 310 laterally thereacross with the rollers 311 rolling along the surface 309 thereof. If desired, pins (not shown) may be utilized so that when the guiding device 310 is in the desired location on the surface 309, it may be fixed in that position against movement. Further, stop blocks 323 (FIG. 10) may be provided on the underside of the member 307 to define the lateral extents to which the guiding device 310 may be moved.

As stated hereinabove, the inventive pavement extractor 1 is preferably attached to the back of a crawler-tractor (not shown). In this regard, with reference back to FIGS. 2 and 3, it is seen that that portion of the main housing 10 directly above the rippers 11 and 13 and the hold-down pressure plate 17 has located thereon a pair of clevises 251, 255. Referring to FIG. 2, clevis 251 includes a pair of aligned holes 252 for receiving a pin 253 which defines with the structure of the clevis 251 a substantially rectangular opening therein. With reference to FIG. 3, the clevis 255 includes similary aligned holes 256 for receipt of a pin 257 which defines with the other structure of the clevis 255 a substantially rectangular opening. Reference numeral 259 designates a tool bar which is commonly attached to the rear portion of a crawler-tractor and controlled by hydraulic cylinders These hydraulic cylinders (not shown) enable the tool bar 259 to be raised and lowered in a controlled manner by the operator of the crawler-tractor. In attaching the extractor 1 to the crawler-tractor, the pins 253 and 257 are removed from their respective holes 252 and 256 and the elongated tool bar 259 is then inserted into the aligned substantially rectangular spaces formed by the respective clevises 251 and 255, whereupon the respective pins 253 and 257 are replaced in their respective holes 252 and 256 to thereby capture the tool bar 259 within the clevices 251 and 255. Thus, the tool bar 259 may be raised to lift the rippers 11 and 13 above the pavement surface, and conversely, the tool bar 259 may be lowered by the operator of the crawler-tractor to thereby cause the pointed ends of the rippers 11 and 13 to engage the pavement surface, whereupon forward movement of the crawler-tractor causes the rippers 11 and 13 to bite into the pavement and thereby remove a swath thereof.

Thus, in describing the operation of the improved pavement extractor 1, the first step in operating the extractor 1 is to attach it to the tool bar of a crawler-tractor as described hereinabove. After this attachment, the input and output lines 105 and 107 of the hydraulic motor 101 (FIG. 4) are attached to the appropriate hydraulic lines emanating from a pump (not shown) which is located on the crawler-tractor and the operation of which is controlled by the operator of the crawler-tractor. At this point, the elevation angle of the elevator mechanism 200 may be adjusted to whatever angle is desired depending upon the type of vehicle which is being used to load the pavement onto. For the first swath of material which is to be removed, the guide mechanism 300 described hereinabove which has been attached to the underside of the dozer blade of the crawler-tractor as further described hereinabove is oriented in a manner so as to space the guide 319 above the pavement surface. With the tool bar 259 lowered so as to enable the pointed ends of the rippers 11 and 13 to engage the surface of the pavement, the above described pump is activated to thereby cause the beater mechanism 47 and the elevator 200 to begin rotating at speeds determined by the respective gear ratios and sprocket ratios of the respective gears and sprockets included in the drive train thereof. At this point, or before the activation of the pump if desired, adjustment of the spacing between the shoe 19 and the floor 15 attached between the rippers 11 and 13 may be made through removal of the pin 21 sliding of the shoe 19 upward or downward with respect to the pressure plate 17 depending upon the desired spacing, and replacement of the pin 21 in connecting relation between the shoe 19 and the pressure plate 17. As stated hereinabove, the optimum spacing between the surface 29 of the shoe 19 and the floor 15 would be approximately 1 inch greater than the thickness of the pavement which is to be removed to enable compensation for buckling of the pavement as it is removed from the roadway by the rippers 11 and 13. With the shoe adjustment having been made, with the tool bar 259 lowered and with the pump (not shown) being activated, the crawler-tractor may be advanced forward to thereby enable the improved pavement extractor 1 to remove a swath of pavement from the roadway. As has been described hereinabove, the pavement is extracted by the interaction between the shoe 19, the rippers 11 and 13 and the floor 15, the pavement traverses the region of the floating plate 31 and enters control chamber 41 where it is controllably held by the rollers 37 and 39 while the beater mechanism 47 operates to beat off pieces of the pavement of a size determined by the position of the plates 51 of the beater mechanism with respect to the control chamber top surface 45 which is formed by the sub-housing 100. Of course, this adjustment is made by the interaction of the bolts 53 with the slots 55 as best seen in FIG. 7.

After the pieces of pavement have been beaten off by the beater mechanism 47, they leave the control chamber 41 and are loaded onto the elevator mechanism 200 which is best seen in FIG. 1. The containment areas 205 on the elevator 200 which are defined between the respective upstanding drag slats 203 convey the pulverized pavement in small granular form upwardly to a point at the top of the elevator 200 where the pulverized pavement may be loaded onto a vehicle such as a dump truck.

After the first swath of pavement has been removed, the dozer blade may be lowered so that the guide 319 engages a wall formed by the side of the swath which was previously removed from the roadway. For this purpose as described hereinabove, the guiding device 310 may be laterally adjusted along the surface 309 to a position where movement of the crawler-tractor with the guide 319 hugging one of the walls of the previously removed swath of pavement will cause the improved pavement extractor 1 extract a second swath of pavement immediately adjacent the first removed swath. In this way, the operator of the crawler-tractor may easily guide the crawler-tractor by feeling the engagement of the guide 319 against the wall of the previously removed swath to thereby keep the crawler-tractor aligned along a path which will enable the next and succeeding swaths to be accurately removed from the roadway. The guide moves to either side of the bar 307 to accommodate a guiding control for the machine to cut into the material from either side of the tractor. Thus, the guiding device 300 is quite useful in improving the efficiency of operation of the inventive pavement extractor 1.

Accordingly, an improved pavement extractor and guiding device have been disclosed herein which greatly increase the efficiency of the process of removing pavement from a roadway and which as such fulfill each and every one of the objects of the invention described hereinabove. Modifications and variations of the teachings of the present invention may occur to those skilled in the art. Accordingly, it is intended that the scope of the invention only be limited by the scope of the following claims.

I claim:

1. An improved pavement extractor comprising:

(a) main housing with a front and back end;

(b) a pair of rippers attached to the front end of said main housing, each said ripper including a top edge and a bottom edge and a substantially pointed front end, said rippers being mounted on the front end of said main housing with the pointed ends facing forward and with a predetermined spacing therebetween;

(c) hold down pressure plate means rigidly mounted on the front end of said housing within said spacing between said rippers and at a predetermined height above the pointed ends of said rippers, said hold down pressure plate means and said rippers defining an opening between said rippers and below said hold down pressure plate means; and (d) means attaching said extractor to a vehicle, whereby forward movement of said vehicle causes said extractor to move forward and said pointed ends to bite into said pavement and said pavement to be extracted and lifted upward along the upper edge of said rippers, said hold down pressure plate means bearing down on a top surface of said pavement between said rippers to thereby cause said extracted pavement to be forced downward and the continued forward movement of said extractor forces said extracted pavement through said opening between said rippers and below said hold down pressure plate means.

2. The extractor of claim 1 wherein the hold down pressure plate means is at a height of 8 to 9 inches above the pointed ends of said rippers.

3. The extractor of claim 1 wherein the hold down pressure plate means is at a height above the pointed ends of said rippers which is about 1 inch higher than the thickness of the pavement that is to be extracted.

4. The extractor of claim 1 wherein the pavement to be extracted is 7 to 8 inches thick.

5. The extractor of claim 1, wherein said means attaching said extractor to a vehicle includes raising and lowering means so that said extractor may be controllably engaged to and disengaged from said pavement.

6. The extractor of claim 1, wherein said vehicle has mounted thereon guide means for guiding the vehicle in a manner so as to enable said extractor to extract adjacent swaths of pavement accurately, said guide means being laterally movable to permit the guide means to control a swath of material from either side of the vehicle.

7. The extractor of claim 6, wherein said vehicle includes a reciprocable blade at a front end thereof, said guide means being attached to said blade and being reciprocable therewith into an opening in said pavement created by a previously removed swath thereof to thereby guide said vehicle and extractor in extracting successive swaths of pavement.

8. The extrator of claim 1, wherein said rippers are connected by floor means extending therebetween and further defining said opening.

9. The extractor of claim 8, wherein said hold down pressure plate means comprises:

(a) a pressure plate;

(b) a shoe attached to said pressure plate, said shoe being vertically adjustable to vary the size of said opening to adapt the extractor to differing pavement thicknesses;

(c) said shoe being rigidly and immovably attached to said pressure plate in any adjusted position thereof whereby said opening is of fixed size for any adjusted position of said shoe.

10. The extractor of claim 1, further including a control chamber into which said pavement is forced after traversing said opening.

11. The extractor of claim 10, further including elevator means beyond said control chamber, said pavement being broken up in said control chamber and then conveyed by said elevator to an elevated location for loading onto an adjacent vehicle.

12. The extractor of claim 10, wherein said control chamber includes an upper roller and a lower roller mounted in substantially opposed relation, said rollers controllably guiding said pavement through said control chamber.

13. The extractor of claim 12, wherein said control chamber further includes a beater mechanism beyond said rollers, said beater mechanism being operative to break off pieces of said pavement as said pavement is guided by said rollers.

14. The extractor of claim 1, further including an inner housing mounted in said main housing, and defining a control chamber between said main housing and said inner housing and said pavement being forced into said control chamber after traversing said opening.

15. The extractor of claim 14, wherein said inner housing is pivotally mounted to said main housing and further including biasing means connected between said main and inner housing to thereby resiliently control pivotal movement of said inner housing with respect to said main housing.

16. The extractor of claim 15, wherein said pivotal movement in a first direction reduces the size of said control chamber and said pivotal movement in a second direction increases the size of said control chamber.

17. An improved pavement extractor comprising:

(a) main housing with front and back end;

(b) a pair of rippers attached to the front end of said main housing, each said ripper including a top edge and a bottom edge and a substantially pointed front end, said rippers being mounted on the front end of said main housing with the pointed front ends facing forward and with a predetermined spacing therebetween;

(c) hold down pressure plate means mounted on the front end of said housing within said spacing between said rippers and at a predetermined height above the pointed ends of said rippers, said hold down pressure plate means and said rippers defining an opening between said rippers and below said hold down pressure plate means;

(d) said extractor including an inner housing mounted in said main housing and defining between said main housing and said inner housing a control chamber into which said pavement is forced after traversing said opening;

(e) said inner housing being pivotly mounted to said main housing and further including biasing means connected between said main and inner housing to thereby resiliantly control pivotable movement of said inner housing with respect to said main housing;

(f) said pivotable movement in a first direction reducing the size of said control chamber and said pivotable movement in a second direction increasing the size of said control chamber and said biasing means, biasing said inner housing in said first direction;

(g) means attaching said extractor to a vehicle, whereby forward movement of said vehicle causes said extractor to move forward and said pointed ends to bite into said pavement and said pavement to be extracted and lifted upward along the upper edge of said rippers, said hold down pressure plate bearing down on a top surface of said pavement between said rippers to thereby cause said extracted pavement to be forced downward and the continued forward movement of said extractors forces said extracted pavement through said opening between said rippers and below said hold down pressure plate means and into and through said control chamber.

18. An improved pavement extractor comprising:

(a) main housing with front and back ends;

(b) a pair of rippers attached to the front end of said main housing, each said ripper including a top edge and a bottom edge and a substantially pointed front end, said rippers being mounted on the front end of said main housing with the pointed front ends facing forward and with a predetermined spacing therebetween;

(c) hold down pressure plate means mounted on the front end of said housing within said spacing between said rippers and at a predetermined height above the pointed ends of said rippers, said hold down pressure plate means and said rippers defining an opening between said rippers and below said hold down pressure means;

(d) said extractor including an inner housing mounted in said main housing and a control chamber being defined between said main housing and said inner housing, wherein said pavement is forced into said control chamber after traversing said opening;

(e) said control chamber including an upper roller and a lower roller mounted in substantailly opposed relation, said rollers controllably guiding said pavement through said control chamber, (f) said control chamber including a beater mechanism beyond said rollers, said beater mechanism comprising a rotory shaft to which are attached a plurality of beater plates, said plates extending into said control chamber a predetermined distance and said beater mechanism being operative to break off pieces of said pavement as said pavement is guided by said rollers;

(g) means attaching said extractor to a vehicle, whereby forward movement of said vehicle causes said extractor to move forward and said pointed ends to bite into said pavement and said pavement to be extracted and lifted upward along the upper edge of said rippers, said hold down pressure plate means bearing down on the top surface of said pavement between said rippers to thereby cause said extracted pavement to be forced downward and the continued forward movement of said extractor forces said extracted pavement through said opening between said rippers and below said hold down pressure plate means, into said control chamber and forcing said pavement into contact with the beater mechanism to break off pieces of said pavement.

* * * * *